US010729306B2

(12) United States Patent
Roos et al.

(10) Patent No.: US 10,729,306 B2
(45) Date of Patent: Aug. 4, 2020

(54) MECHANISM FOR UNLOCKING AN ELEVATED LOWER RACK OF A DISHWASHER

(71) Applicant: ELECTROLUX APPLIANCES AKTIEBOLAG, Stockholm (SE)

(72) Inventors: Matteus Roos, Stockholm (SE); Per Källberg, Stockholm (SE); Erik Josefsson, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 15/575,045

(22) PCT Filed: May 22, 2015

(86) PCT No.: PCT/EP2015/061427
§ 371 (c)(1),
(2) Date: Nov. 17, 2017

(87) PCT Pub. No.: WO2016/188554
PCT Pub. Date: Dec. 1, 2016

(65) Prior Publication Data

US 2018/0140165 A1 May 24, 2018

(51) Int. Cl.
*A47L 15/50* (2006.01)
*A47B 96/07* (2006.01)
*A47B 46/00* (2006.01)

(52) U.S. Cl.
CPC ..... *A47L 15/506* (2013.01); *A47B 96/07* (2013.01); *A47B 46/005* (2013.01); *A47B 2210/17* (2013.01); *A47L 15/507* (2013.01)

(58) Field of Classification Search
CPC .... A47L 15/504; A47L 15/506; A47L 15/507; A47B 96/07; A47B 46/005; A47B 2210/17

(Continued)

(56) References Cited

U.S. PATENT DOCUMENTS 2,919,966 A * 1/1960 Preston ..... A47B 21/02 126/337 A
3,466,108 A * 9/1969 Guth ..... A47L 15/506 126/340

(Continued)

FOREIGN PATENT DOCUMENTS

CN 1582841 A 2/2005
CN 101897518 A 12/2010

(Continued)

OTHER PUBLICATIONS

International Search Report and Written Opinion of the International Searching Authority for International Patent Application No. PCT/EP2015/061427 dated Jul. 7, 2015, 9 pages.

(Continued)

*Primary Examiner* — Jonathan Liu
*Assistant Examiner* — Devin K Barnett
(74) *Attorney, Agent, or Firm* — Alston & Bird LLP

(57) ABSTRACT

A mechanism for unlocking an elevated lower rack is provided in an arrangement for a dishwasher being capable of elevating the lower rack from a lower position to an upper position and locking the elevated lower rack in the upper position. The elevating arrangement may include a spring loaded pivot arm arrangement to be attached in one end to a tub of the dishwasher and in another end to the lower rack for elevating the lower rack from the lower position inside the tub to the upper position at least partially outside the tub. The elevating arrangement may further include a locking mechanism arranged between the spring loaded pivot arm arrangement and the lower rack, which may lock the spring loaded pivot arm arrangement when the lower rack has been elevated to the upper position, thereby fixing the lower rack in the upper position.

14 Claims, 6 Drawing Sheets

(58) Field of Classification Search
USPC ..... 312/311, 228.1, 325, 319.2, 319.3; 211/41.8, 41.9; 134/56 D, 57 D
See application file for complete search history.

(56) References Cited

U.S. PATENT DOCUMENTS

| | | | | |
|---|---|---|---|---|
| 5,308,158 | A * | 5/1994 | Vogelgesang | A47B 77/10 211/170 |
| 5,480,035 | A * | 1/1996 | Smith | A47L 15/503 211/168 |
| 6,247,771 | B1 * | 6/2001 | Miller | A47L 15/506 312/272 |
| 6,536,860 | B1 * | 3/2003 | Heidmann | E05F 1/1075 312/319.2 |
| 7,651,180 | B2 * | 1/2010 | Deiss | A47L 15/504 312/311 |
| 8,424,692 | B2 * | 4/2013 | Ala | F25D 25/02 134/135 |
| 9,022,496 | B2 * | 5/2015 | Armstrong | F24C 15/16 312/319.3 |
| 9,596,975 | B2 * | 3/2017 | Bhajak | A47L 15/4246 |
| 9,895,046 | B1 * | 2/2018 | Wilson | A47L 15/504 |
| 10,016,115 | B2 * | 7/2018 | Gerstner | A47L 15/506 |
| 10,045,682 | B2 * | 8/2018 | Gerstner | A47L 15/506 |
| 2004/0103932 | A1 * | 6/2004 | Kim | A47L 15/504 134/137 |
| 2004/0163687 | A1 * | 8/2004 | Son | A47L 15/506 134/58 D |
| 2005/0039782 | A1 * | 2/2005 | Kim | A47L 15/504 134/58 D |
| 2005/0206282 | A1 * | 9/2005 | Walburn | A47B 46/005 312/312 |
| 2006/0066189 | A1 * | 3/2006 | Bond | A47B 46/00 312/319.1 |
| 2006/0119236 | A1 * | 6/2006 | Dickson | A47L 15/504 312/311 |
| 2007/0035220 | A1 * | 2/2007 | Bond | A47B 46/00 312/319.1 |
| 2008/0011337 | A1 * | 1/2008 | Ryu | A47L 15/504 134/147 |
| 2008/0129168 | A1 | 6/2008 | Banta et al. | |
| 2008/0272072 | A1 * | 11/2008 | Tynes | A47L 15/504 211/41.8 |
| 2009/0151758 | A1 * | 6/2009 | Kristensson | A47L 15/4257 134/201 |
| 2010/0066227 | A1 * | 3/2010 | Ramm | A47B 51/00 312/408 |
| 2012/0074080 | A1 | 3/2012 | Garcia et al. | |
| 2012/0111366 | A1 * | 5/2012 | Baldwin | A47L 15/4259 134/18 |
| 2012/0153786 | A1 * | 6/2012 | Kucuk | A47L 15/4272 312/228 |
| 2012/0161598 | A1 * | 6/2012 | Blum | E05F 1/1276 312/319.2 |
| 2012/0291824 | A1 * | 11/2012 | Bhajak | A47L 15/504 134/135 |
| 2012/0298598 | A1 * | 11/2012 | Ennen | A47L 15/0034 211/41.8 |
| 2014/0132147 | A1 * | 5/2014 | Tarcy | A47B 57/06 312/410 |
| 2015/0002005 | A1 * | 1/2015 | Park | A47L 15/507 312/228.1 |
| 2016/0331204 | A1 * | 11/2016 | Kutto | A47L 15/504 |
| 2017/0086646 | A1 * | 3/2017 | Kim | A47L 15/504 |
| 2017/0224190 | A1 * | 8/2017 | Sakthivel | A47L 15/506 |
| 2017/0332879 | A1 * | 11/2017 | Gerstner | A47L 15/503 |

FOREIGN PATENT DOCUMENTS

| | | |
|---|---|---|
| CN | 104602567 A | 5/2015 |
| EP | 2818092 | 12/2014 |
| WO | WO-2014/033092 | 3/2014 |

OTHER PUBLICATIONS

Office Action for Chinese Application No. 2015800079893.6 dated Aug. 7, 2019, 5 pages (no English translation available).

* cited by examiner

MECHANISM FOR UNLOCKING AN ELEVATED LOWER RACK OF A DISHWASHER

CROSS-REFERENCE TO RELATED APPLICATIONS

This application is a national stage application filed under 35 U.S.C. § 371 of International Application No. PCT/EP2015/061427 filed May 22, 2015, which application is hereby incorporated by reference in its entirety.

TECHNICAL FIELD

The invention relates to a mechanism for unlocking an elevated lower rack of a dishwasher, the lower rack being capable of being elevated from a lower position to an upper position and further being capable of being locked in the upper position.

BACKGROUND

Traditionally in dishwashers, racks for housing goods to be cleaned can only be moved horizontally in and out of a tub of the dishwasher. For a lower rack placed at a bottom of the tub, a user will have to bend over to perform loading or unloading of goods. This may result in physical discomfort, in particular for disabled and/or elder people.

Therefore, rack elevation arrangements have been developed to move the lower rack from a lower position at the bottom of the tub to an upper position where the rack is moved out of the tub and elevated to a height on a level with an upper rack, by means of spring loaded pivot arms lifting the lower rack from its lower position to its upper position. Such a rack elevation arrangement is disclosed for instance in US 2012/0074080 or WO 2014/033092. When in the upper position, the lower rack is locked to prevent it from being displaced, thereby facilitating for a user the loading and unloading of goods in the lower rack.

A problem with this rack elevation arrangement is the operation that a user will have to perform to return the lower rack from the upper, locked position to its lower position. In WO 2014/033092, the user needs to push the elevated lower rack, being locked in the upper position, along a sliding rail in which the lower rack is mounted in a horizontal direction towards the interior of the dishwasher. Upon horizontal displacement of the lower rack towards the interior of the dishwasher, the lower rack will unlock and the user can press the lower rack towards its lower position at the bottom of the tub, thereby causing the spring loaded pivot arms to return the lower rack to its lower position.

SUMMARY

An object of the present invention is to solve, or at least mitigate, this problem in the art and to provide an improved mechanism for unlocking an elevated lower rack of a dishwasher.

This object is attained in a first aspect of the invention by a mechanism for unlocking an elevated lower rack in an arrangement for a dishwasher being capable of elevating the lower rack from a lower position to an upper position and locking the elevated lower rack in the upper position. The elevating arrangement comprises a spring loaded pivot arm arrangement to be attached in one end to a tub of the dishwasher and in another end to the lower rack for elevating the lower rack from the lower position inside the tub to the upper position at least partially outside the tub. The elevating arrangement further comprises a locking mechanism arranged between the spring loaded pivot arm arrangement and the lower rack and configured to lock the spring loaded pivot arm arrangement when the lower rack has been elevated to the upper position, thereby fixing the lower rack in the upper position. The mechanism for unlocking the elevated lower rack is characterized in comprising a lever extending from a front of the lower rack along each side of the lower rack to the locking mechanism being located at a respective side of the rack, wherein user operation of the lever at the front of the elevated lower rack causes a respective end of the lever to act on the locking mechanism located at the respective side of the rack to unlock the elevated lower rack such that it can be lowered into its lower position.

Advantageously, by having the lever act on the locking mechanism, an intuitive solution for unlocking the elevated lower rack and returning it to its lower position inside the dishwasher tub is provided. A user can easily operate the lever at the front of the elevated lower rack in order to cause the ends of the lever to act on the locking mechanism on each side of the rack and thus unlock the elevated lower rack.

In contrast to the art, where the user must push the rack horizontally a distance in the direction of the interior of the tub such that the locking mechanism will unlock, before pushing the rack down to its lower position, which is not an obvious sequence of a user to perform, the user intuitively and straightforwardly moves the lever of the present invention in an upwards directions and simply unlocks the elevated lower rack. The user can thereafter move the elevated lower rack to its lower position in the tub.

A further advantage of the invention as compared to the art is that goods of a greater height can be placed in a back section of the lower rack, since there is no need to push the rack a distance horizontally into the tub in order to unlock the locking mechanism before lowering the rack in which case goods of a great height will bang against the upper rack when the elevated lower rack 11 is moved downwards to its lower position. In the art, there is a risk that the goods are damaged when contacting the upper rack, and goods banging against the upper rack are further a source to noise. Further advantageous is that since there is no need to displace the rack horizontally to unlock the locking mechanism, a heavily loaded rack is easy to manage as compared to the art where a heavily loaded rack causes a user to apply a certain force to unlock the locking mechanism.

In an embodiment, the lever is equipped with a handle that can be operated by the user; by pressing the handle, the lever will move upwards at the front of the elevated lower rack, thus causing the ends of the lever to correspondingly move in an upwards direction to unlock the rack, thereby advantageously providing an easy, straightforward and intuitive way for the user to unlock the elevated upper rack and return the rack to its lower position.

In a further embodiment of the invention, the respective end of the lever will lift a locking pin of the locking mechanism on each side of the rack from a groove retaining the lower rack in the upper locked position by preventing the spring loaded pivot arm arrangement from performing a pivoting movement and hence the rack from being moved to its lower position in the interior of the dishwasher tub. By lifting the locking pin, the pin is no longer in engagement with the groove, wherein the elevated lower rack can be moved by means of the spring loaded pivot arm arrangement in a downwards direction and be returned to its lower position.

In still a further embodiment of the invention, the unlocking mechanism further comprises a force transmission mechanism pivotably attached in one of its ends to the lever, and an unlocking element pivotably attached to the other end of the force transmission mechanism on a distance from the lever. The unlocking element is configured to move the locking pin from engagement with the groove upon upwards movement of the lever to unlock the elevated upper rack. Advantageously, with the force transmission mechanism, a small upward movement of the lever will result in a greater upwards movement of the unlocking element. Thus, with this advantageous embodiment, a user will only slightly have to displace the lever in an upward direct in order to unlock the elevated upper rack.

In a second aspect of the invention, a lower rack elevating arrangement for use in a dishwasher is provided comprising the mechanism for unlocking an elevated lower rack as described herein.

In a third aspect of the invention, a dishwasher is provided comprising the mechanism for unlocking an elevated lower rack as described herein.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
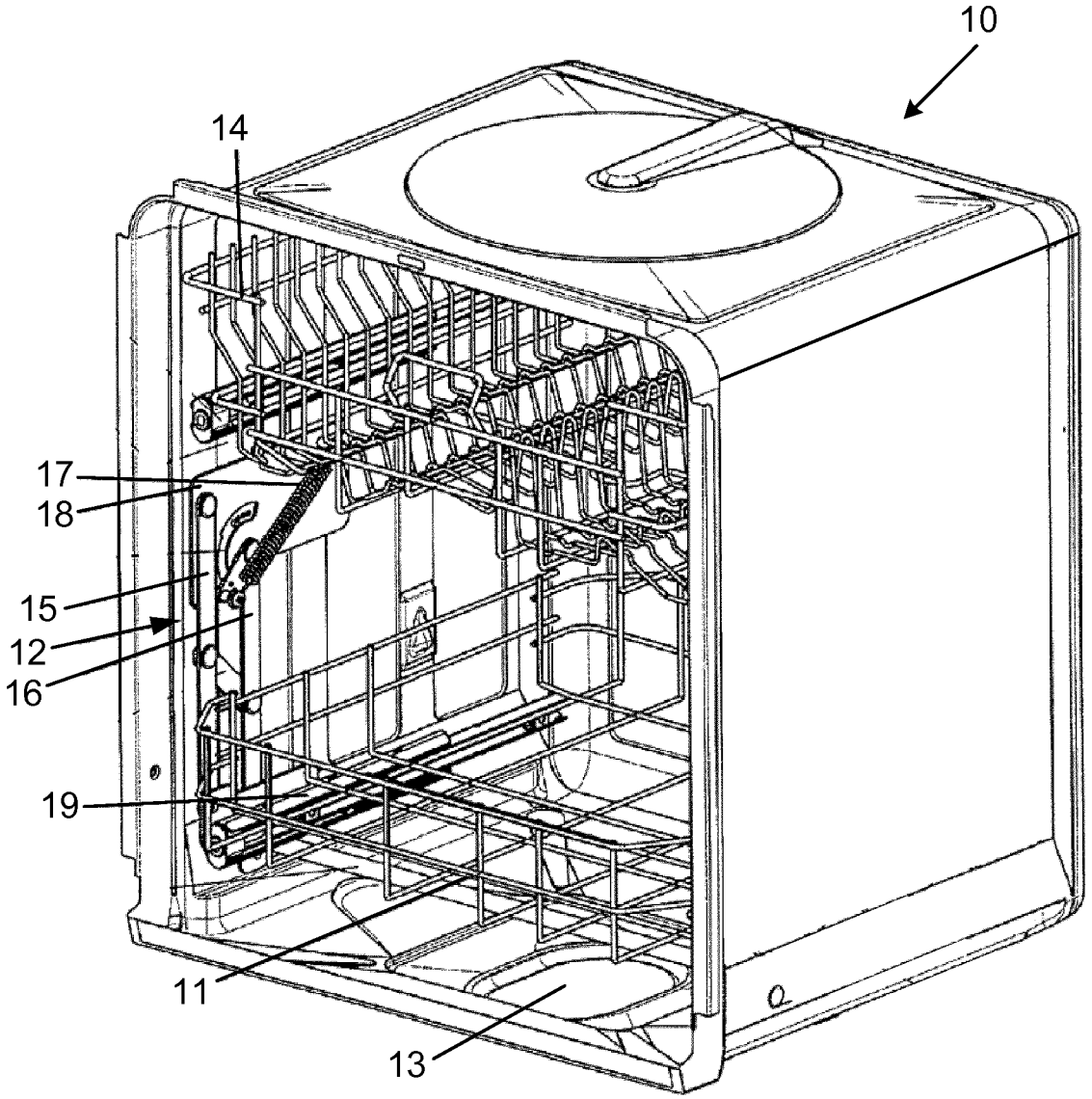
FIG. 1 illustrates a prior art dishwasher in which a mechanism according to an embodiment of the invention advantageously may be implemented.

FIG. 1 illustrates a prior art dishwasher 10 as disclosed in US 2012/0074080, in which a mechanism according to an embodiment of the invention advantageously may be implemented. The operation of elevating the lower rack 11 from its lower position to its upper position (in which it subsequently will be locked) will be briefly described in the following with reference to FIGS. 1-3. It should be noted that the described solution for elevating the lower rack to its upper position is exemplifying only, and a number of different ways of elevating the lower rack can be envisaged.

FIG. 1 shows a spring loaded pivot arm arrangement 12 for elevating the lower rack 11 from its lower position at a bottom of the tub 13 to an upper position on a level with an upper rack 14 of the dishwasher 10. In this example, the spring loaded pivot arm arrangement 12 comprises two pivot arms 15, 16 and one spring 17. When the lower rack 11 is in its lower position in an interior of the tub 13, the pivot arms 15, 16 are positioned vertically and parallel at a distance from each other, while the spring 17 is tensioned by being attached to a fixture 18. The lower rack 11 is attached to sliding rails 19 which in their turn are mounted to guiding rails 20 (see FIG. 2) on an interior wall of the tub 13 such that the lower rack can be moved in and out of the tub 13 when in its lower position. Alternatively, the lower rack 11 may be equipped with sliding means in the form of small wheels to move the rack in and out of the tub 13 in its lower position.

Figure 2:
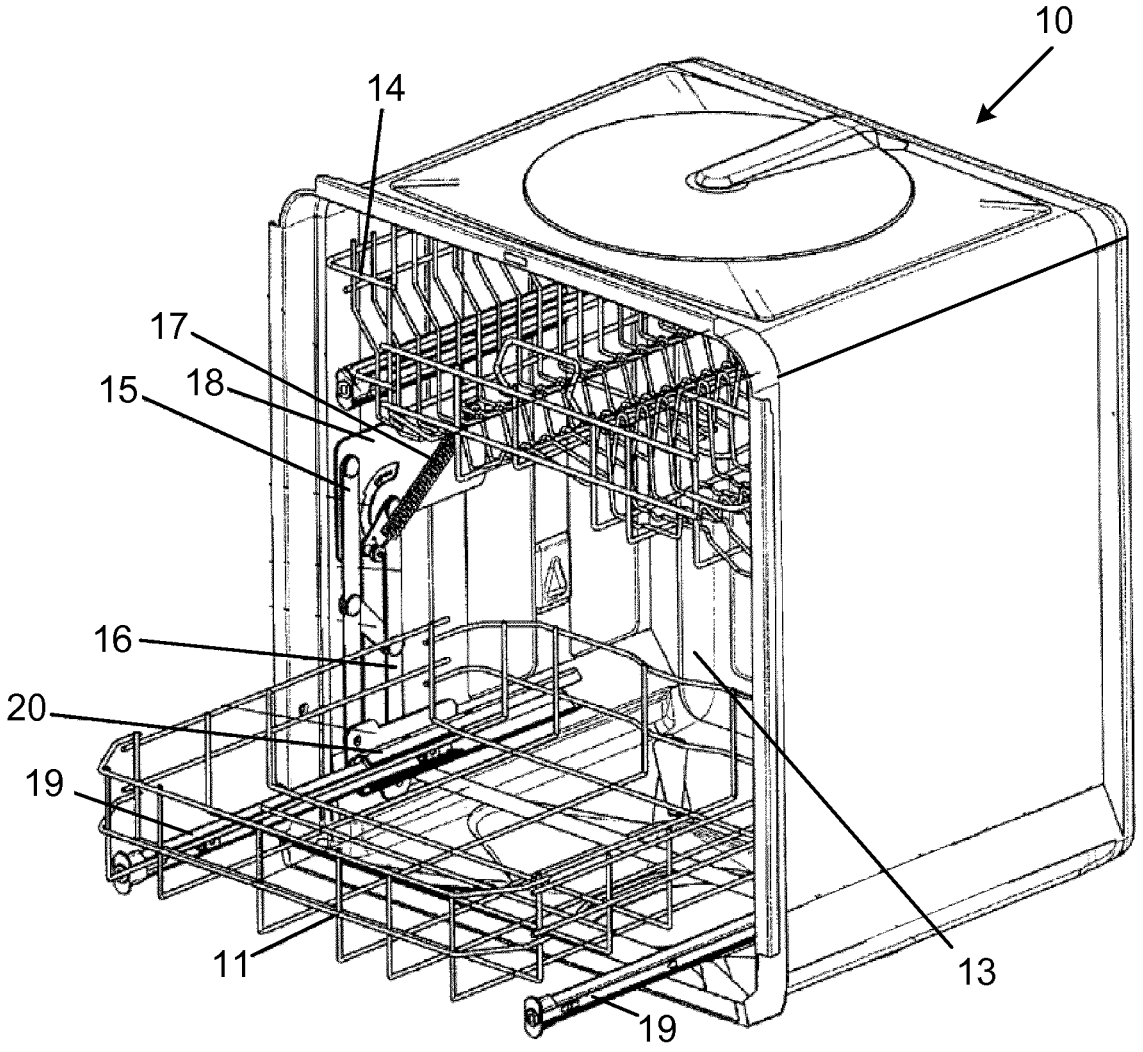
FIG. 2 illustrates the prior art dishwasher of FIG. 1 where a lower rack is moved from its lower position towards an upper position.

FIG. 2 illustrates a scenario where a user (not shown) moves the lower rack 11 from its lower position to the upper position, t. Hence, the pivot arms 15, 16 are rotated in a clockwise direction by the user lifting the lower rack 11 and the spring 17 will support the elevation.

Figure 3:
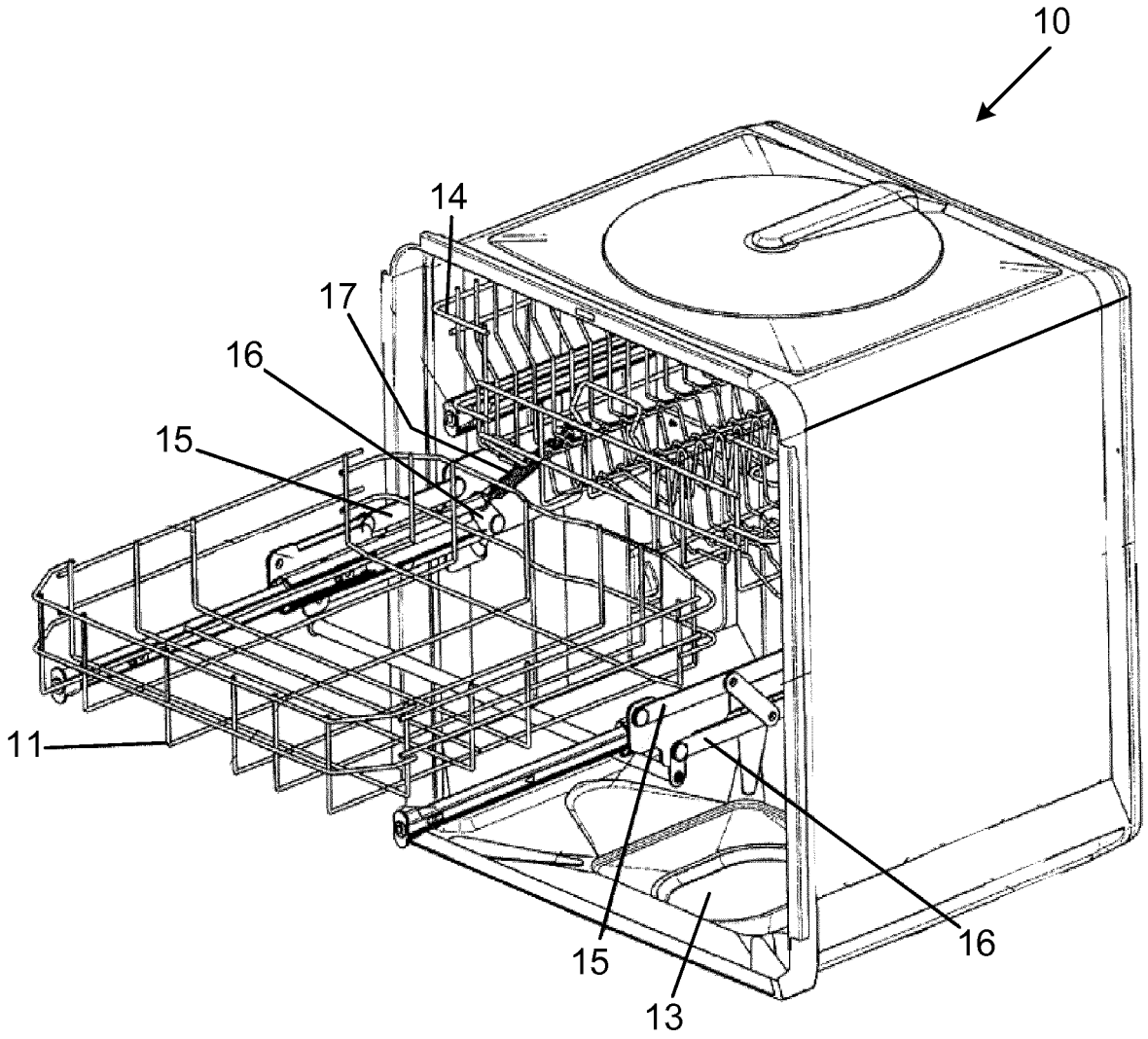
FIG. 3 illustrates the prior art dishwasher of FIGS. 1 and 2 where the lower rack has been moved from the lower position to the upper position.

FIG. 3 shows the lower rack 11 having reached its upper position outside of the tub 13 and on a level with the upper rack 14. The pivot arms 15, 16 will thus protrude horizontally from the tub 13 while the spring 17 enters a relaxed, non-tensioned state. A locking mechanism (shown in subsequent Figures) will retain the lower rack 11 in the upper position by locking the spring loaded pivot arm arrangement 12 until being released by a user, whereupon the lower rack 11 will return to its lower position in analogy with the elevating movement described with reference to FIGS. 1-3.

Figure 4:
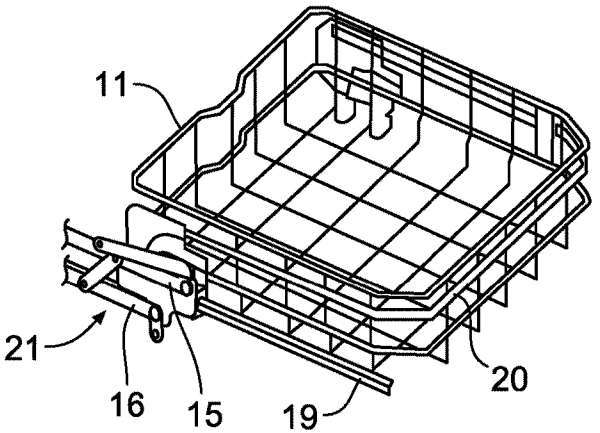
FIG. 4 illustrates a mechanism for unlocking an elevated lower rack according to an embodiment of the invention, the mechanism not being operated by a user thereby retaining the rack locked in the upper position.
Figure 6:
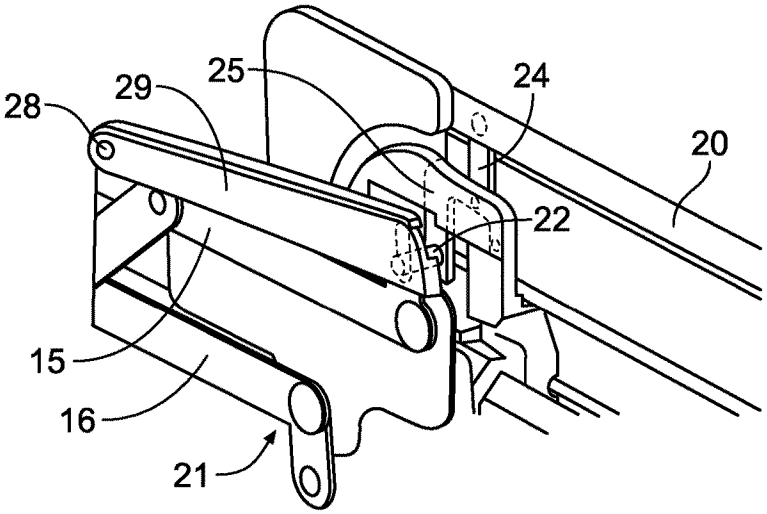
FIG. 6 illustrates the mechanism for unlocking an elevated lower rack according to an embodiment of the invention, the mechanism being operated by a user thereby unlocking the rack.
Figure 7:
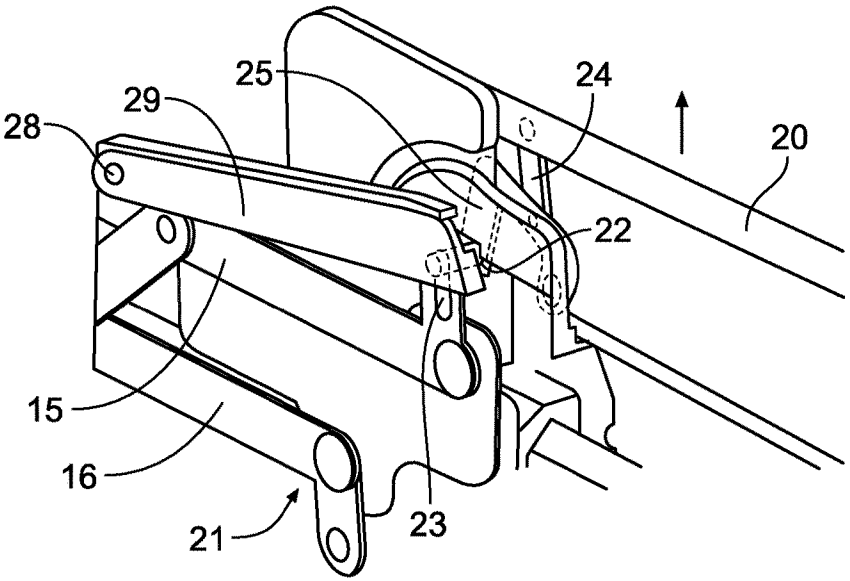
FIG. 7 illustrates the locking mechanism of FIG. 5 on which the mechanism for unlocking an elevated lower rack acts in order to unlock the rack according to an embodiment of the invention.

FIG. 4 illustrates a mechanism for unlocking an elevated lower rack 11 according to an embodiment of the invention. As is illustrated in FIG. 4, the lower rack 11 has been elevated to its upper position outside of the tub 13 and locked for facilitating loading and unloading of goods (not show) in the rack 11. The mechanism comprises a lever 20 extending from a front of the lower rack 11 along each side of the rack to a locking mechanism 21 being located at a respective far back corner of the rack 11 and arranged to lock the spring loaded pivot arm arrangement 12 to prevent the elevated upper rack 11 from being moved by preventing rotation of the pivot arms 15, 16. The locking mechanism may include a locking bar 29 rotatably attached to pivot arm 15 at one end 28, such that in an instance in which the lower rack 11 is in the upper position, the locking bar 29 may rotate to allow the locking pin 22 to removably engage with the groove 23 as illustrated in FIGS. 6-7. Advantageously, as will be described in the following, a user operating the lever 20 at the front of the rack 11 by moving the lever 20 in an upwards direction causes a respective end of the lever 20 to act on the locking mechanism 21 located at the respective far back corner of the rack 11 to unlock the elevated rack 11 such that it can be lowered into its lower position inside the tub 13.

Figure 5:
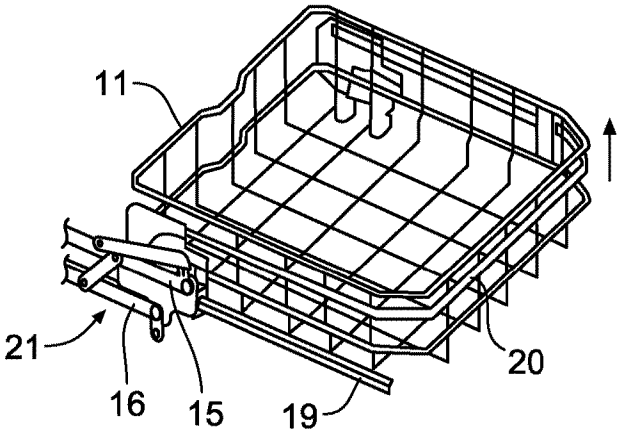
FIG. 5 illustrates a locking mechanism on which the mechanism for unlocking an elevated lower rack do not act in order to retain the rack locked according to an embodiment of the invention.

FIG. 5 illustrates the locking mechanism 21, on which the lever 20 acts, in more detail. When the lower rack 11 is elevated to its upper position, a locking pin 22 is configured to engage with a groove 23, thereby preventing the spring loaded pivot arm arrangement 12 from performing a pivoting movement (e.g., preventing rotation of the pivot arms 15, 16 and hence the elevated lower rack 11 from being moved in a direction towards the lower position in the interior of the tub 13. The locking pin 22 may engage the locking bar 29 as discussed herein. Hence, the rack 11 cannot be moved to its lower position when the locking pin 22 is in locking engagement with the groove 23 as the pin prevents any movement of the rack 11 along the sliding rail 19 in the upper position.

FIG. 6 illustrates the mechanism for unlocking an elevated lower rack 11 according to the embodiment of the invention discussed with reference to FIG. 4. However, in contrast to FIG. 4, the lever 20 extending from the front of the lower rack 11 along each side of the rack to the locking mechanism 21 being located at a respective far back corner of the rack 11 is in FIG. 6 moved upwards thereby unlocking the rack 11. The locking pin 22 may be engage the locking bar 29, and the locking bar 29 may be rotatably attached to pivot arm 15 at one end 28, such that in an instance in which the lower rack 11 is in the upper position, the locking bar 29 may rotate to allow the locking pin 22 to engage with the groove 23 as illustrated in FIGS. 6-7. Thus, the user operates the lever 20 at the front of the rack 11 by moving the lever 20 in an upward direction. As a result, the respective end of the lever 20 acts on the locking mechanism 21 causing unlocking of the elevated rack 11 such that it can be lowered into its lower position inside the tub 13 (e.g., by rotating the pivot arms 15, 16).

FIG. 7 illustrates the locking mechanism 21 when being unlocked by the lever 20 in an embodiment of the invention. When the lower rack 11 is elevated to its upper position, and a user moves the lever in an upward direction, the locking pin 22 is configured to slide out of the groove 23, such that the locking pin 22 no longer is in locking engagement with the groove, and the spring loaded pivot arm arrangement 12 is no longer being prevented from pivoting and being moved downwards in a direction towards the interior of the tub 13. Hence, the unlocked elevated lower rack 11 can easily be moved to its lower position by having the user slightly push the rack 11 downwards into the tub to rotate the pivot arms 15, 16. In an instance in which the lever 20 moves upward, the actuation of the locking pin 22 may cause the locking bar 29 to rotate away from the pivot arm 15 and also the groove 23.

Advantageously, the invention provides for a user an intuitive way of unlocking the elevated lower rack 11 when locked in its upper position as compared to the art where the user must push the rack horizontally a distance in the direction of the interior of the tub such that the locking mechanism will unlock, before pushing the rack down to its lower position, which is not an obvious sequence of a user to perform. A further advantage of the invention as compared to the art is that goods of a greater height can be placed at the back of the lower rack 11, since there is no need to push the rack a distance horizontally into the tub in order to unlock the locking mechanism 21 before lowering the rack in which case goods of a great height will abut the upper rack 14 when the elevated lower rack 11 is moved downwards to its lower position. In the art, there is a risk that the goods are damaged when abutting the upper rack 14. Further advantageous is that since there is no need to displace the rack 11 horizontally to unlock the locking mechanism 21, a heavily loaded rack 11 is easy to manage as compared to the art where a heavily loaded rack causes a user to apply a certain force to unlock the locking mechanism.

With reference to FIG. 7, in a further embodiment of the invention, a force transmission mechanism 24 is pivotably attached in one of its ends to the lever 20, and an unlocking element 25 is pivotably attached to the other end of the force transmission mechanism 24 on a distance from the lever 20. As can be seen in FIG. 7, the unlocking element 25 is configured to move the locking pin 22 from engagement with the groove 23 upon upwards movement of the lever 20 to unlock the elevated upper rack 11. As illustrated in FIGS. 6-7, upon actuation of the force transmission mechanism 24 by the lever 20, the unlocking element 25 rotates clockwise in the depicted perspective about a pivot point at an opposite end on the unlocking element 25 from the pin 22. Advantageously, with the force transmission mechanism 24, a small upward movement of the lever 20 will result in a greater upwards movement of the unlocking element 25. Thus, with this advantageous embodiment, a user will only slightly have to displace the lever 20 in an upward direct in order to unlock the elevated upper rack 11.

Figure 8:
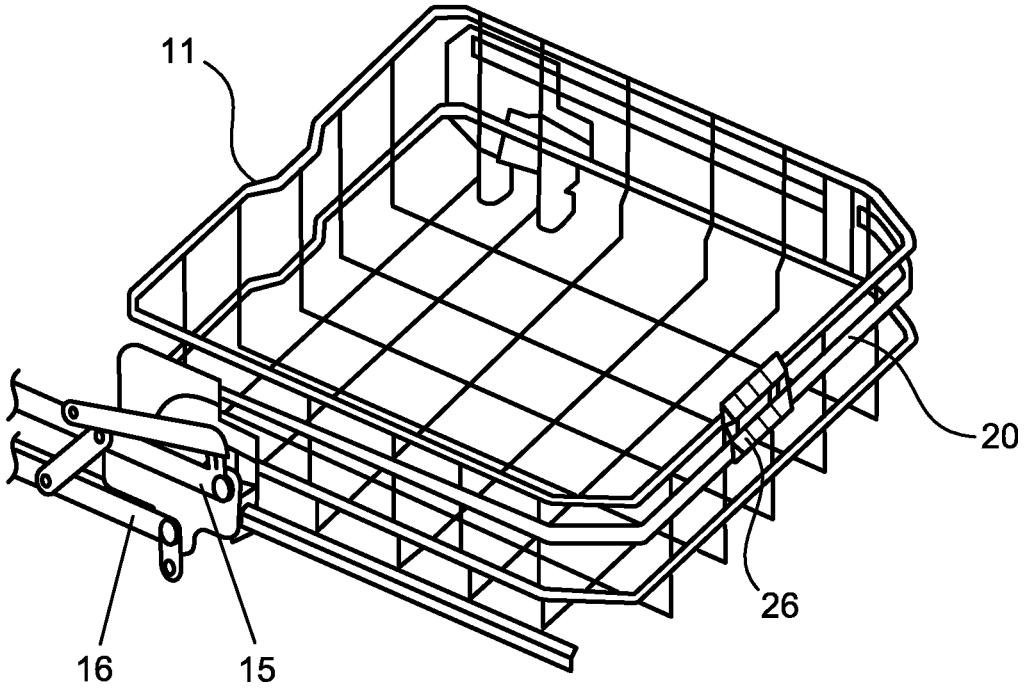
FIG. 8 illustrates the mechanism for unlocking an elevated lower rack further comprising a handle according to an embodiment of the invention.

FIG. 8 illustrates a further embodiment of the mechanism for unlocking the elevated lower rack 11. In this embodiment, the mechanism further comprises a handle 26 arranged at the front of the lower rack 11. The handle 26 is advantageously configured to move the lever 20 upwards when being pressed by a user in order to unlock the elevated lower rack 11, thereby providing an easy, straightforward and intuitive way for the user to unlock the elevated upper rack 11 and return the rack to its lower position by rotating the pivot arms 15', 16'.

Figure 9:
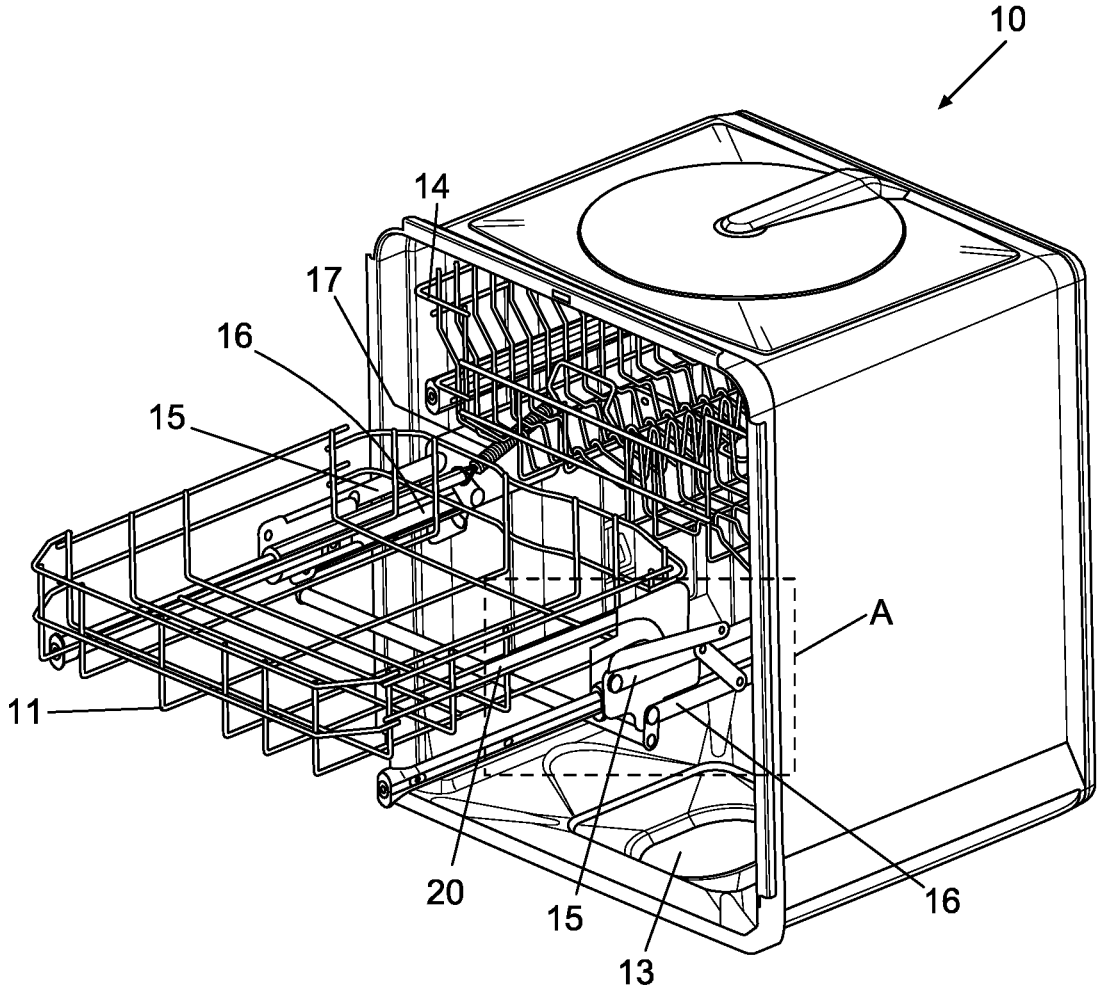
FIG. 9 illustrates the mechanism, such as the one shown in FIG. 8, partially installed on an elevated lower rack in accordance with an example embodiment of the present disclosure.

FIG. 9 illustrates an example embodiment of the mechanism for unlocking the elevated lower rack 11. In this embodiment, the mechanism, shown within Box A, is installed within the dishwasher of the prior art (e.g., FIG. 3), such that the rack 11 may be locked in an elevated position and unlocked to move to a lower position. Pivot arms 15', 16' are shown with the locking mechanism attached as described in reference to FIGS. 4-8.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A mechanism for unlocking an elevated lower rack in an arrangement for a dishwasher being capable of elevating the lower rack from a lower position to an upper position and locking the elevated lower rack in the upper position, the mechanism for unlocking the elevated lower rack comprising:

a spring loaded pivot arm arrangement to be attached at one end to a tub of the dishwasher and at another end to the lower rack for elevating the lower rack from the lower position inside the tub to the upper position at least partially outside the tub;

a locking mechanism arranged between the spring loaded pivot arm arrangement and the lower rack and configured to lock the spring loaded pivot arm arrangement when the lower rack has been elevated to the upper position, thereby fixing the lower rack in the upper position; the mechanism for unlocking the elevated lower rack further comprising:

a generally U-shaped lever extending along a front and each side of the lower rack to the locking mechanism being located at a respective side of the rack, wherein user operation of the lever at the front of the elevated lower rack causes a respective end of the lever to act on the locking mechanism located at the respective side of the rack to unlock the elevated lower rack such that it can be lowered into its lower position.

2. The mechanism for unlocking an elevated lower rack according to claim 1, wherein movement of the lever in an upward direction causes the respective end of the lever to move upwards to unlock the locking mechanism.

3. The mechanism for unlocking an elevated lower rack according to claim 1, the locking mechanism comprising:

a locking pin configured to engage with a groove in order to prevent the spring loaded pivot arm arrangement from pivoting and being moved in a downwards direction towards an interior of the tub, thereby locking the elevated lower rack.

4. The mechanism for unlocking an elevated lower rack according to claim 3, the lever being configured, when moved in an upwards direction, to cause the respective end of the lever to release the locking pin from engagement with the groove in order to allow the spring loaded pivot arm arrangement to move in a downwards direction towards an interior of the tub, thereby unlocking the elevated lower rack.

5. The mechanism for unlocking an elevated lower rack according to claim 4, further comprising:

a respective force transmission mechanism pivotably attached at one end of the respective force transmission mechanism to the respective end of the lever;

a respective unlocking element pivotably attached to the other end of the respective force transmission mechanism on a distance from the lever, the unlocking element being configured to move the locking pin from engagement with the groove upon upwards movement of the lever.

6. The mechanism for unlocking an elevated lower rack according to claim 1, wherein the locking mechanism is located at a respective far back corner of the rack.

7. The mechanism for unlocking an elevated lower rack according to claim 1, further comprising:

a handle arranged at the front of the lower rack configured to move the lever upwards when being pressed by a user in order to unlock the elevated lower rack.

8. An arrangement for a dishwasher configured to elevate a lower dishwasher rack from a lower position to an upper position and locking the elevated lower rack in the upper position, the arrangement comprising:

a spring loaded pivot arm arrangement configured to be attached at one end to a tub of the dishwasher and at another end to the lower rack for elevating the lower rack from the lower position inside the tub to the upper position at least partially outside the tub;

a locking mechanism arranged between the spring loaded pivot arm arrangement and the lower rack and configured to lock the spring loaded pivot arm arrangement when the lower rack has been elevated to the upper position, thereby fixing the lower rack in the upper position; the arrangement further comprising:

a generally U-shaped lever extending along a front and each side of the lower rack to the locking mechanism being located at a respective far side of the rack, wherein user operation of the lever at the front of the elevated lower rack causes a respective end of the lever to act on the locking mechanism located at the respective side of the rack to unlock the elevated lower rack such that it can be lowered into its lower position.

9. A dishwasher comprising the mechanism for unlocking an elevated lower rack according to claim 1.

10. A dishwasher comprising the arrangement for elevating the lower rack from a lower position to an upper position according to claim 8.

11. A mechanism comprising:

a first arm and a second arm operatively coupled to a rack;

a locking mechanism arranged between the first arm and the rack and configured to lock the first arm and second arm to prevent vertical motion of the rack and at least one sliding rail from an upper position, wherein the locking mechanism comprises a locking pin configured to engage with a groove in order to prevent the first arm and second arm from pivoting and being moved in a downwards direction, thereby locking the rack;

a generally U-shaped lever extending along a front and each side of the rack to the locking mechanism being located at a respective side of the rack, wherein user operation of the lever at the front of the elevated lower rack causes a respective end of the lever to act on the locking mechanism located at the respective side of the rack to unlock the rack such that it can be lowered into a lower position, wherein the lever being further configured, when moved in an upwards direction, to cause the respective end of the lever to release the locking pin from engagement with the groove in order to allow the first arm and second arm to move in a downwards direction, thereby unlocking the rack;

a respective force transmission mechanism pivotably attached at one end of the respective force transmission mechanism to the respective end of the lever: and a respective unlocking element pivotably attached to the other end of the respective force transmission mechanism on a distance from the lever, the unlocking element being configured to move the locking pin from engagement with the groove upon upwards movement of the lever.

12. The mechanism according to claim 11, wherein movement of the lever in an upward direction causes the respective end of the lever to move upwards to unlock the locking mechanism.

13. The mechanism according to claim 11, wherein the locking mechanism is located at a respective far back corner of the rack.

14. The mechanism according to claim 11, further comprising:

a handle arranged at the front of the rack configured to move the lever upwards when being pressed by a user in order to unlock the rack.

* * * * *